United States Patent [19]

York

[11] 4,431,083

[45] Feb. 14, 1984

[54] APPARATUS FOR LIFTING A MEMBER USING PARALLELOGRAM MOUNTED LINKS

[75] Inventor: Lyle E. York, Peoria, Ill.

[73] Assignee: Caterpillar Tractor Co., Peoria, Ill.

[21] Appl. No.: 262,059

[22] PCT Filed: Oct. 20, 1980

[86] PCT No.: PCT/US80/01403

§ 371 Date: Oct. 20, 1980

§ 102(e) Date: Oct. 20, 1980

[87] PCT Pub. No.: WO82/01362

PCT Pub. Date: Apr. 29, 1982

[51] Int. Cl.[3] ..... B66B 9/20

[52] U.S. Cl. ..... 187/9 E; 414/631; 414/696

[58] Field of Search ..... 187/9 E, 9 R, 18, 8.72, 187/8.71; 414/DIG. 917, 630, 706, 710, 711, 685; 182/141; 414/631, 628, 629, 707, 696

[56] References Cited

U.S. PATENT DOCUMENTS

| | | | |
|---|---|---|---|
| 2,980,271 | 4/1961 | Ulinski | 414/707 |
| 3,826,392 | 7/1974 | Farley | 414/630 |
| 4,054,185 | 10/1977 | Stedman | 187/9 E |
| 4,059,172 | 11/1977 | Stedman | 187/9 E |
| 4,084,715 | 4/1978 | Stedman | 187/9 E |
| 4,124,099 | 11/1978 | Dudynskyj | 187/9 R |

FOREIGN PATENT DOCUMENTS 99672 8/1964 Denmark .

OTHER PUBLICATIONS

"Straight-Line Mechanisms", Data Sheet 20, *Automotive Design Engineering*, Apr. 1, 1964.

*Primary Examiner*—Joseph J. Rolla
*Assistant Examiner*—Kenneth Noland
*Attorney, Agent, or Firm*—Alan J. Hickman

[57] ABSTRACT

Conventional lifting mechanisms for positioning materials with respect to a frame such as lift trucks, cranes, and front end loaders frequently have undesirable components of motion. For example, the motion of the mast on a conventional fork lift truck with a parallelogram linkage contains substantial horizontal displacement. The apparatus (48) of the present invention substantially reduces undesirable components of motion by, for example, utilizing a lifting linkage (49) comprising an upper pair of links (50,52), a medial pair of links (58,60), a connecting link (66), and a lower pair of links (68,69). The linkage (49) also includes a guide channel (78) which directs the lower pair of links (68,69) along a predetermined path with respect to the lift truck (40).

8 Claims, 7 Drawing Figures

APPARATUS FOR LIFTING A MEMBER USING PARALLELOGRAM MOUNTED LINKS

DESCRIPTION

1. Technical Field

The present invention relates to lifting mechanisms and, more particularly, to apparatus for positioning materials using parallelogram linkages. Such apparatus include conveying systems and material positioning vehicles.

2. Background Art

Conveying systems and material positioning vehicles often utilize parallelogram linkages to position loads. For example, lift trucks, cranes and front end loaders have such mechanisms. More specifically, a fork lift truck having a mast assembly that is supported by a parallelogram linkage is disclosed in U.S. Pat. No. 4,054,185 entitled "Mast Control Mechanism", by R. Stedman, issued Oct. 18, 1977 and assigned to the assignee of the present invention. The linkage includes one pair of vertically spaced apart arms pivotally connected at their forward ends to the lift truck and pivotally connected at their rearward ends to a second pair of vertically spaced apart arms. The second pair of arms is pivotally connected at their forward ends to the mast of the lift truck. A control linkage pivotally anchored to the lift truck, to the arm of the first pair of arms and to the mast causes the mast to move in a substantially straight path.

Other patents that describe positioning linkages include U.S. Pat. No. 2,980,271 entitled "Lifting Mechanism for Industrial Truck" by Ulinski issued Apr. 18, 1961; U.S. Pat. No. 3,826,392 entitled "Lifting Device" by Farley issued July 30, 1974; U.S. Pat. No. 4,059,172 entitled "Lift Truck Mast Positioning Mechanism" by Stedman issued Nov. 27, 1977 and assigned to the assignee of the present invention; and U.S. Pat. No. 4,084,715 entitled "Lift Truck with Means to Pivot Mast and The Fork Carriage Thereon" by Stedman issued Apr. 18, 1978 and assigned to the assignee of the present invention.

When parallelogram lifting linkages are used on lift trucks to raise and lower the fork carriage, the tips of the forks describe an arc. In the industry this arcuate path is called swing out and the arc is inherent in parallelogram lifting linkages because the lifting arms are mounted on pins and are thus restricted to travel along circular paths.

The arcuate path of the forks raises three problems. The first problem is that during lifting, the center of mass of the load is displaced away from the lift truck and a moment arm is created. Such a moment arm can reduce the capacity of the lift truck because either heavier counterweights or smaller loads may be required. Secondly, when lifting a load, the operator must compensate for the forward motion of the mast assembly lifting the load. This forward motion will cause the operator to reposition the vehicle in order to clear any objects adjacent or behind the load being lifted. In addition, the positioning of the forks for engagement with the load to be lifted or lowered is more difficult because as the forks are being moved vertically, the forks are also moving horizontally with respect to the load. This requires further repositioning of the vehicle. Thirdly, the bottom margin of the outer pair of uprights also travels on an arcuate path when the mast assembly is lowered. If the lift truck is abutting an object such as a tote box, the bottom front corner of the outer upright may swing forward during lowering depending on its elevation and may contact the underlying tote box.

One prior solution to the problem of swing out was to incline the forks at a predetermined angle relative to the mast. This inclination tended to reduce the swing out at two ends of motion but made it very difficult to pick up a tote box at an elevated position with the forks.

The present invention is directed to overcoming one or more of the problems as set forth above.

DISCLOSURE OF THE INVENTION

In one aspect of this invention, an apparatus for lifting a member relative to a frame is disclosed. The apparatus comprises an upper pair of links pinned together at a common end and with one remote end pinned to the frame and with the other remote end pinned to the member. In addition, the apparatus comprises a medial pair of links pinned together at a common end and with one remote end pinned to the frame and with the other remote end pinned to the member. The upper and medial pairs of links are separated by a connecting link pinned to the common ends of the pairs of links. The apparatus further comprises a lower pair of links pinned together at a common end and with one remote end pinned to the link in the medial pair nearer the member and with the other remote end pinned to the link nearer the frame. Further, the apparatus includes means mounted on the frame for guiding the lower pair of links along a predetermined path with respect to the frame.

The principal purpose of the invention is to reduce the arcuate path or swing out described by the tips of the forks during vertical motion on fork lift trucks using side mounted linkage to support the mast assembly. This purpose is achieved by elevating the mast with the linkage disclosed herein. More specifically, this linkage controls swing out, reduces the displacement of the center of mass of the load away from the lift truck during lifting, eliminates forward motion of the load during lifting, and solves the problem of lowering the bottom margin of the lower pair of uprights down on an underlying box or object.

A further purpose of the present invention is to achieve the same lifting height as comparable lift trucks in the industry while eliminating swing out of the mast during lifting. A comparable vertical lifting height is achieved by the present invention because the linkage disclosed herein is utilized.

One feature of the present invention is that the forks can be programmed to follow a predetermined path. This path can be vertical, inclined, arcuate or variable and is achieved through use of a guide channel. The path of the forks follows a guide path established by the guide channel. A lift truck utilizing this feature can be programmed to operate in a very narrow isle and in locations where there is virtually no maneuvering space.

The present invention also avoids the problem of inclination of the forks relative to the mast. In the present invention the forks remain in the same horizontal orientation along the entire range of motion of the mast.

Other aspects, objects, and advantages of the invention can be obtained from a study of the drawings, the disclosure, and the appended claims.

BEST MODE FOR CARRYING OUT THE INVENTION

Figures 1, 2:
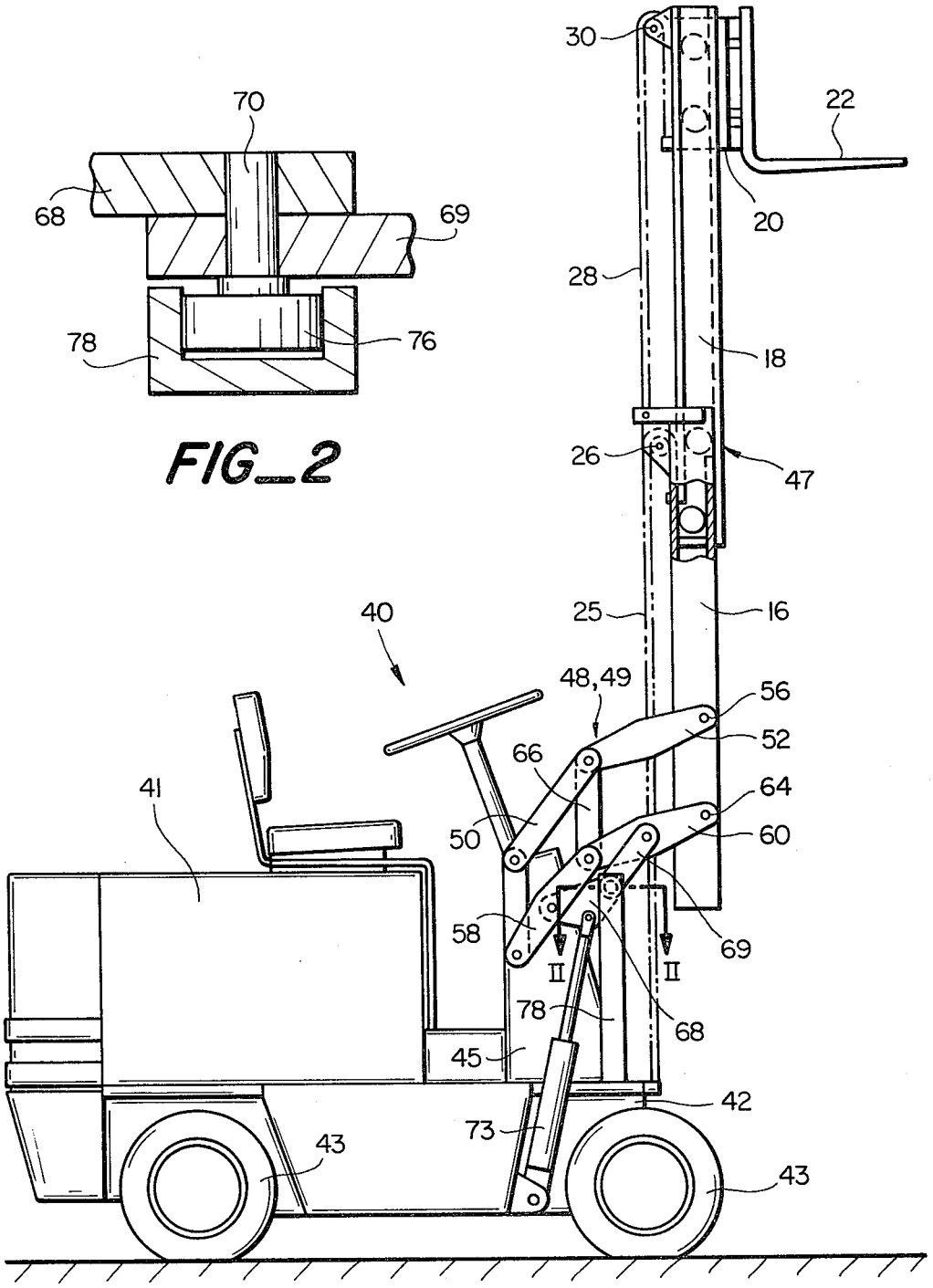
FIG. 1 is a side elevational view, broken away and partially in cross section, of an embodiment according to the present invention.
FIG. 2 is a partial sectional plan view taken along line 2—2 of the guide channel of FIG. 1.

Referring to the figures, an apparatus 48 is shown for lifting one member 47 relative to a frame. The apparatus is connected to, for example, a lift truck 40 that includes a body 41 which is mounted on a frame 42. The frame is supported by a pair of front drive wheels 43 and a pair of rear steerable wheels 43. The frame has a mounting tower 45 secured to and extending upward from the forward end of the frame 42. The member 47 is an upwardly extending mast that is disposed adjacent to the forward end of the frame 42. The mast includes two sets of telescoping uprights 16,18, a carriage 20, lifting forks 22, a mast chain 25, a carriage chain 28, and two sheaves 26,30. These components are constructed and operate in the same manner as the lift truck described in U.S. Pat. No. 4,054,185 identified above.

Figure 3:
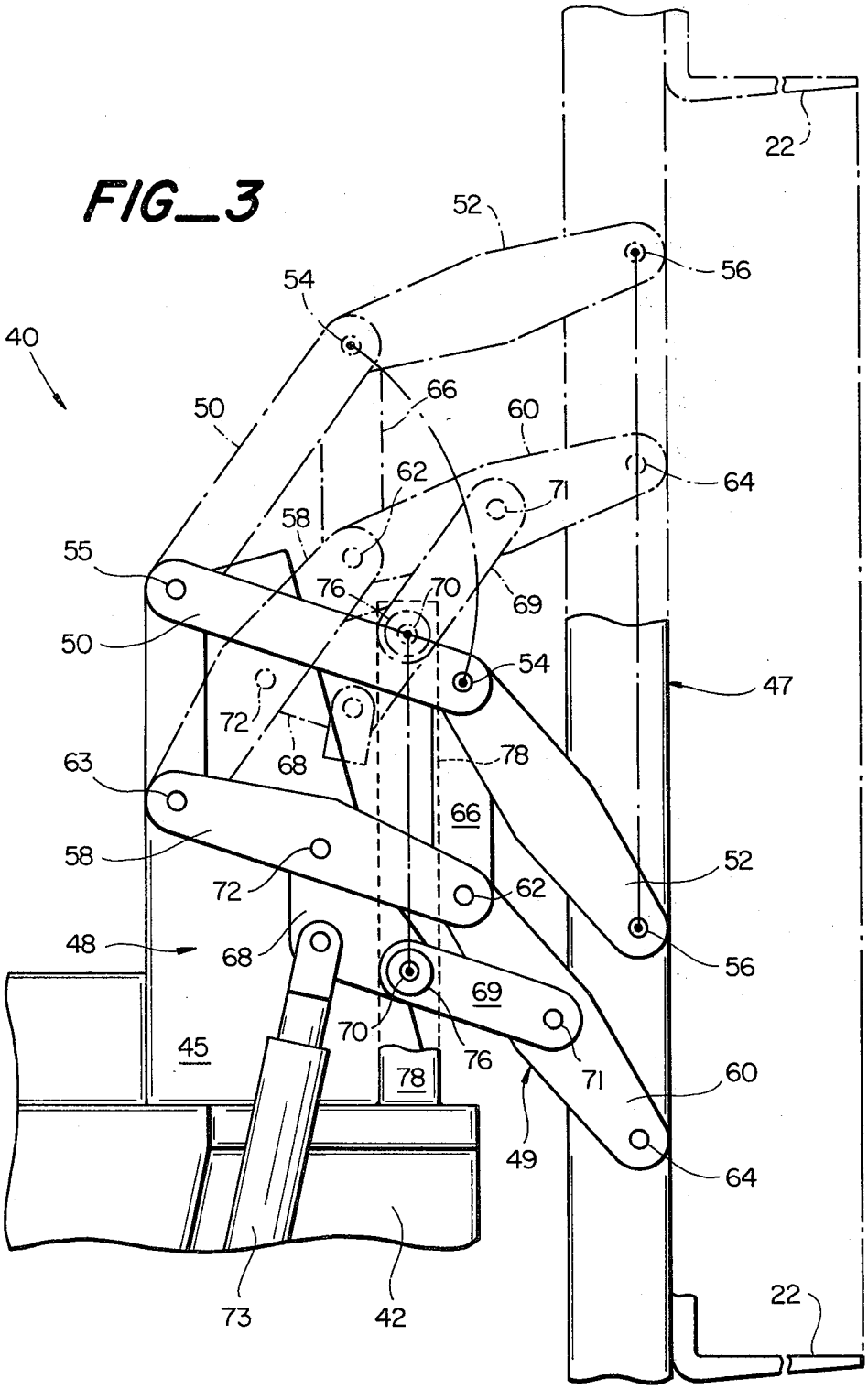
FIG. 3 is a sectional side elevational view of the lift linkage of FIG. 1.

Referring to FIGS. 1–3, the mast 47 is elevated and lowered using the apparatus 48 of the present invention. The apparatus includes a linkage 49 having an upper pair of elongate links 50,52 which are pivotally pinned together at a common end with a pin 54. The link 50 nearest the mounting tower 45 is pivotally attached to the tower with a pin 55. In addition, the link 52 nearer the mast 47 is pivotally attached to the mast with a pin 56.

The linkage 49 also includes a medial pair of elongate links 58,60 that are pivotally pinned at a common end with a pin 62. The link 58 nearer the mounting tower 45 is pivotally mounted to the tower with a pin 63. Likewise the link 60 is pivotally mounted to the mast 47 with a pin 64. The common ends of the four links 50,52,58,60 are maintained in vertically spaced relationship by a link 66 that is connected to the upper and medial pairs of links by the pins 54,62. Link 66 is an elongate, generally vertically oriented link.

The linkage 49 of the present invention also includes a control linkage 67 which supports and aligns the medial and upper links 50,52,58 and 60. The control linkage includes a lower pair of links which are hereafter identified as the drive link 68 and the control link 69. The drive link is a triangular shaped link which applies the mast elevating force to links 58 and 60. The drive link is pivotally connected to link 58 by a pin 72 that is located midway between pins 62 and 63. The control link 69 is an elongate link which is connected to link 60 by a pin 71 that is located midway between pins 62 and 64. The control link 69 is an elongate link which is connected to link 60 by a pin 71 that is located midway between pins 62 and 64. The control link 69 supports the link 60 and the mast 47 and controls the position of pin 64 with respect to pin 62 as described below. The drive link 68 and the control link 69 are pivotally mounted at common ends by a pin 70 which controls the motion of the mast 47 and more particularly the forks 22 in the manner described below. The linkage and the mast 47 are elevated and lowered with a hydraulic cylinder 73 which is pinned to the lift truck for pivotal motion with a clevice type mount. The operating arm of the hydraulic cylinder is pivotally mounted to the drive link 68.

Figure 4:
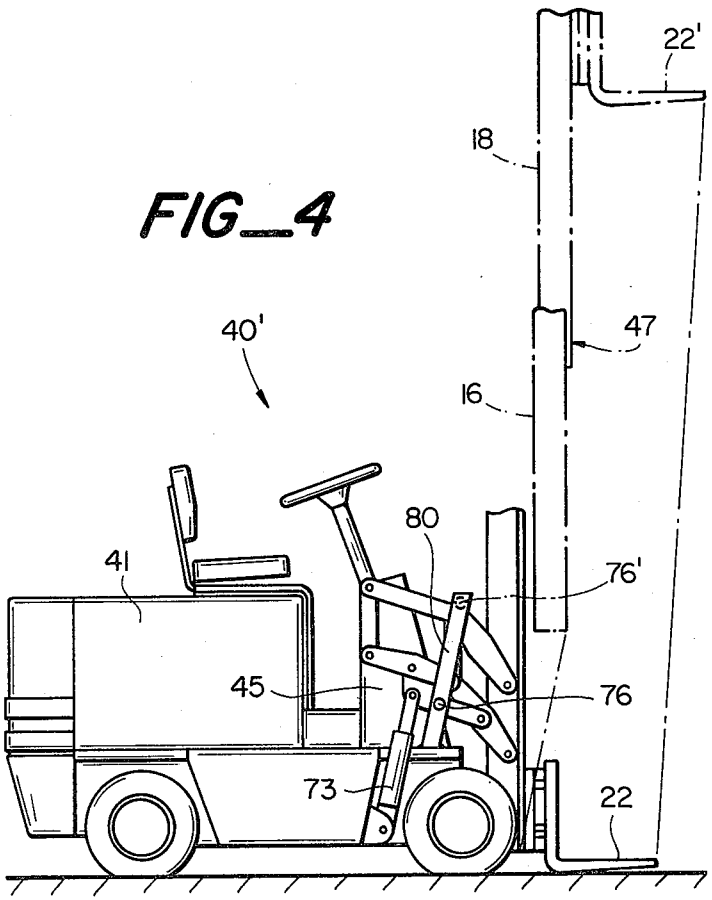
FIG. 4 is a side elevational view of a lift truck having a mast partially broken away and shown in solid lines in the lowered position and phantom lines in the raised position and a guide channel that is inclined with respect to the vertical according to a second embodiment of the present invention.

These five links 50,52,58,60 and 66 form two parallelograms which are maintained throughout the range of motion of the mast 47 as illustrated in FIGS. 3 and 4. One parallelogram includes links 50,66,58, and the mounting tower 45. The other parallelogram includes the links 52,66,60 and the lower parallel upright 16. The control linkage forms a third parallelogram that includes links 68,69 and the common ends of links 58 and 60.

Referring to FIGS. 1–3, shaft 70, which connects the drive link 68 and the control link 69 together, terminates in a roller 76. Shaft 70 forms an axle for the roller and the roller moves within a guide channel 78 like a follower moving along a cam surface. The guide channel defines the path of the roller and in turn guides the motion of the forks 22 via the linkage. The guide channel illustrated in FIG. 1 is a vertically oriented so that the roller 76 follows a predetermined vertical guide path. The roller in turn directs the linkage 49 so that the forks 22 likewise follow a vertical path relative to the lift truck.

It should be appreciated from FIGS. 1 and 3 that the rectanglar shaped drive link 68 can be replaced by elongate link extending between pins 70,72 and the cylinder 73 can be connected to either link 50 or 58 if circumstances dictate. The hydraulic cylinder 73 is connected to the drive link 68 in the manner shown so that a cylinder having a short stroke can be utilized and placed out of the way of the linkage.

INDUSTRIAL APPLICABILITY

The fork lift truck 40 illustrated in FIGS. 1–3 uses the guide channel 78 having a guide path that directs the fork 22 in a vertical direction. This motion is illustrated in FIGS. 1 and 3. In particular, when the hydraulic cylinder 73 extends, link 58 pivots around pin 63 which is rigidly mounted on the mounting tower 45. Referring to FIG. 3, it should be appreciated that links 58 and 50 are capable of only pivotal motion about the respective pins 63,55. In FIG. 3 these links move in a counterclockwise direction about pins 55,63 when the hydraulic cylinder 73 is extended. The motion of the roller 76 is constrained in the guide channel 78 so that the roller can only move up and down along a vertical path. When the hydraulic cylinder 73 extends, the combination of the pins 55,63 and the guide channel 78 causes the control link 69 to move in a clockwise direction (rearwardly and downwardly as illustrated in FIG. 3)

with respect to pin 62. The net effect of the elongation of the hydraulic cylinder 73 is that pins 64,56 move vertically upward along the path dictated by the guide axis of the guide channel 78.

The linkage 49 illustrated in FIG. 1 is connected to the lower set of parallel uprights 16 by pins 56,64. When the hydraulic cylinder 73 extends, the linkage 49 elevates the lower set of uprights 16. Since the mast chain 25 is rigidly attached to the frame 42 of the lift truck 40, the chain elevates the upper pair of uprights via the sheave 26. In like manner the elevation of the upper pair of uprights 18 causes the carriage 20 and the forks 22 to elevate because the carriage chain 28 is rigidly attached to the lower pair of uprights 16 and operates through the sheave 30. A more detailed explanation of the motion of the forks 22 and the carriage 20 is found in the Stedman patent identified above.

The forks 22, FIG. 1, are lowered by retracting the hydraulic cylinder 73. The pins 56,64 move vertically downward as illustrated in FIG. 3 because motion of the linkage is constrained by the guide channel 78. This motion is exactly opposite to the elevating motion described above.

The linkage of the present invention forms two parallelograms that are movable relative to each other and which generate a tracking motion. The two parallelograms are formed by the pins 50,66,58 and the mounting tower 45 and the links 52,66,60 and the mast 47. The links 50,58 are pinned to stationary positions and are permitted only rotational motion about the mounting points 55,63. The tracking motion is achieved because the roller 76 is constrained to move along a predetermined or programmed path and this path is duplicated by the motion of the forks 22.

ALTERNATIVE MODES FOR CARRYING OUT THE INVENTION

In FIG. 4 a lift truck 40' utilizes a straight guide channel 80 that is inclined with respect to the vertical. The guide channel is inclined in a forward direction although it can also be inclined toward the rear of the lift truck with corresponding results. The guide channel is rigidly attached to the lift truck 40' so that a straight guide path is produced that does not vary relative to the lift truck. The linkage is constructed and operated in the same manner as the linkage described above.

When the hydraulic cylinder used with the lift truck 40' of FIG. 4 extends, the roller 76 moves in an upward and forward direction with respect to the lift truck. Like the embodiment of FIGS. 1–3, the guide channel 80 constrains and directs the roller and in turn the linkage along a predetermined guide path. As the mast 47 elevates, the forks move upward and in a forward direction along the guide path dictated by the guide channel. The mast 47 at all times remains oriented in a vertical direction because of the use of the double parallelogram linkage. The forks 22' correspond to the roller 76' in an elevated position.

Figure 5:
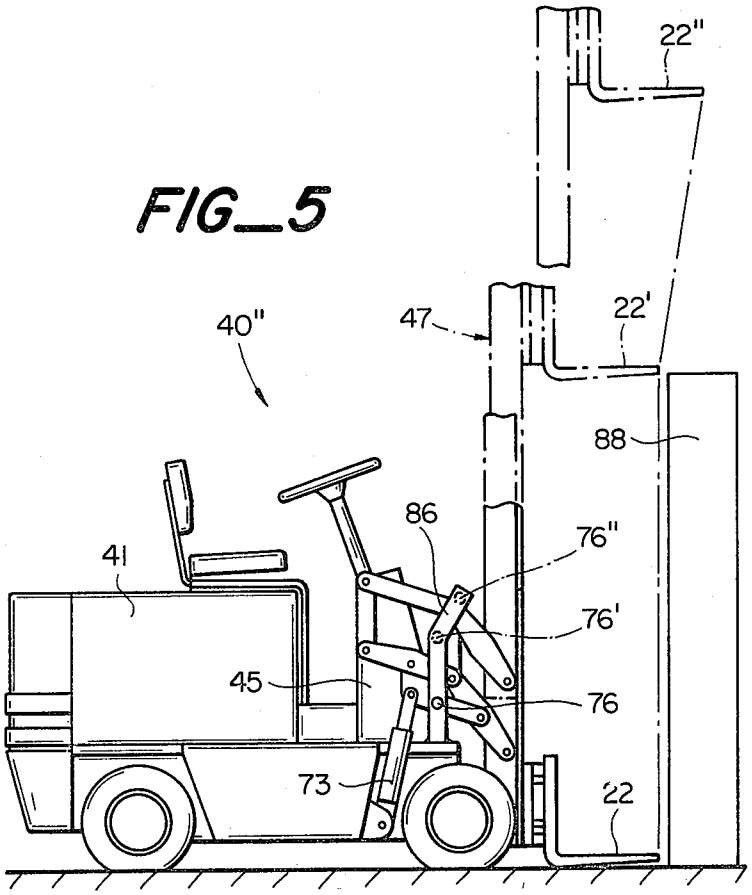
FIG. 5 is a side elevational view of a lift truck having a mast partially broken away and shown in solid lines in the lowered position and phantom lines in the raised position and a guide channel that has an arcuate guide path according to a third embodiment of the present invention.

FIG. 5 illustates a lift truck 40'' that utilizes a guide channel 86 with an arcuate guide path. The guide channel is rigidly attached to the lift truck and has a sharp medial bend which forms the arcuate guide path. The roller 76 is directed along the guide channel in the same manner as described above and the linkage moves the forks 22 in a similar manner. When the roller moves to the positions indicated by numerals 76,76',76'', the forks move to the corresponding positions 22,22', and 22''. The guide channel thus can be used to program the motion of the forks around and over various objects 88.

Figure 6B:
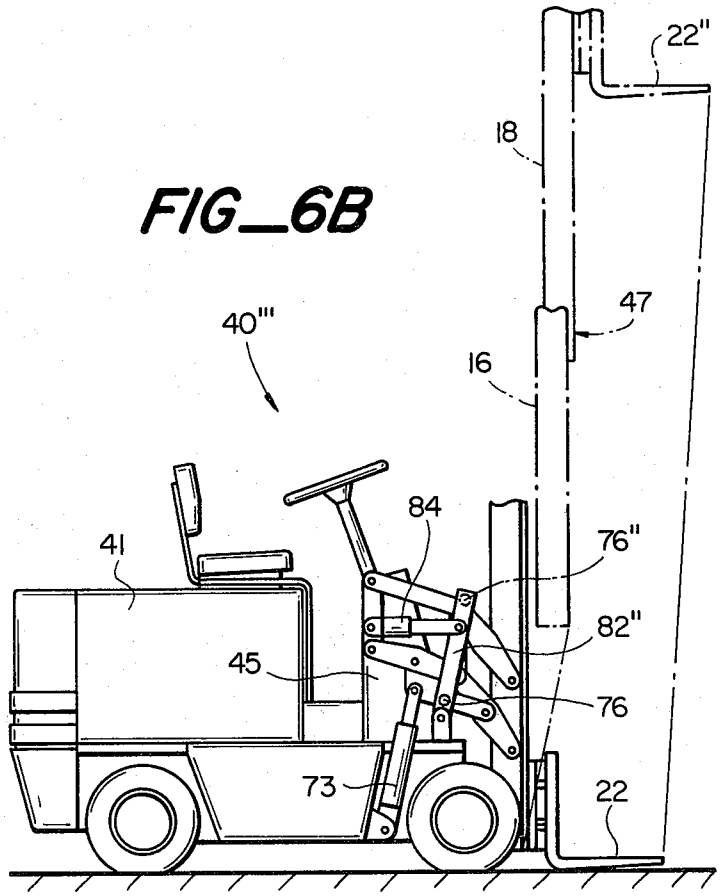
FIGS. 6A and 6B are side elevational views of a lift truck having a mast partially broken away and shown in solid lines in the lowered position and phantom lines in the raised position and a guide channel pivotally mounted on the lift truck according to a fourth embodiment of the present invention.
Figure 6A:
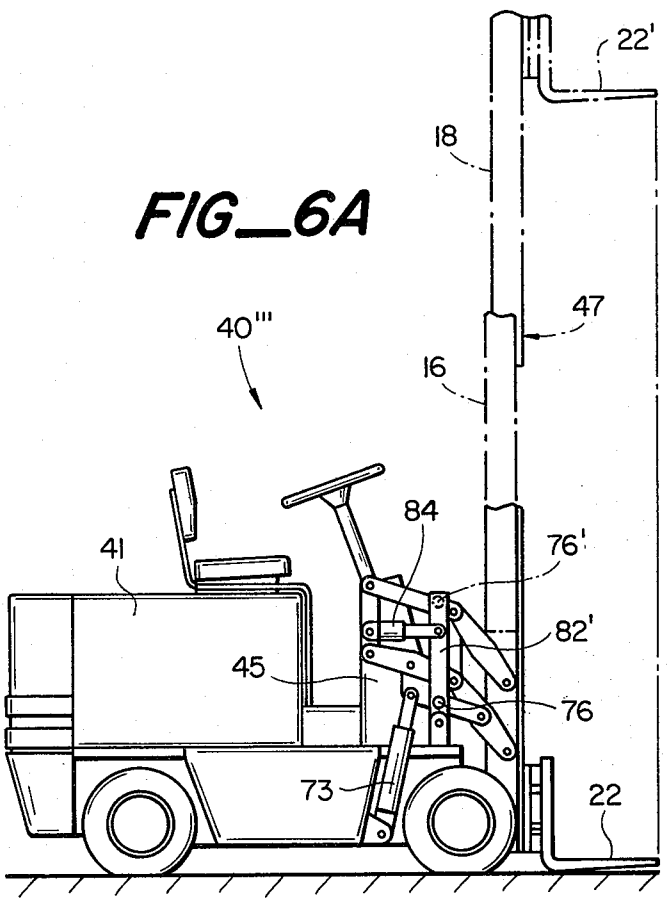

FIGS. 6A and 6B illustrate a guide channel 82',82'', that has a straight guide path and which can be inclined to various positions with respect to the vertical. The guide channel 82,82'' is pinned to the lift truck and is moved back and forth longitudinally usng the hydraulic cylinder 84. The lifting linkage is constructed and operated in the same manner as described above.

In FIGS. 6A and 6B the position of the hydraulic cylinder 84 controls the orientation of the guide path and the forks 22 are programmed by actuating the hydraulic cylinder 84 to travel the various paths. The mast 47 at all times remains vertical and the forks 22 follow a path corresponding to the path of the roller 76 as it engages the guide channel 82. In FIGS. 6A and 6B the position of the roller 76' corresponds to the position of the forks 22' and likewise the position of roller 76'' corresponds to the position of the forks 22''. When the roller moves between these points, the forks follow the paths indicated.

Thus, in view of the foregoing it can be seen that by utilizing the linkage disclosed herein swing out described by the forks during vertical motion can be substantially reduced. In addition, this reduction in swing out can be achieved while maintaining the same overall lifting height as comparable lift trucks in the industry. Further, the forks can be programmed to follow a predetermined path for various job applications.

Other aspects, objects, and advantages of the invention can be obtained from a study of the drawings, the disclosure, and the appended claims.

I claim:

1. Apparatus (48) for lifting a member (47) relative to a frame (42), comprising:

(a) an upper pair of elongate links (50,52) pinned together at a common end with a first pin (54), said pair of links (50,52) having one remote end pinned to the frame (42) with a second pin (55) and a second remote end pinned to the member (47) with a third pin (56);

(b) a medial pair of elongate links (58,60) pinned together at a common end with a fourth pin (62), said pair of links (58,60) having one remote end pinned to the frame (42) with a fifth pin (63) and a second remote end pinned to the member (47) with a sixth pin (64);

(c) an elongate connecting link (66) pinned with the first and fourth pins (54,62 respectively) to the common ends of the upper and medial pairs of links (50,52 and 58,60 respectively);

(d) a lower pair of links (68,69) pinned together at a common end with a seventh pin (70), said pair of links (68,69) having one remote end pinned to the link (60) in the medial pair of links (58,60) nearer the member (47) and a second remote end pinned to the link (58) in the medial pair of links (58,60) nearer the frame (42); and (e) means (76,78) mounted on the frame (42) for guiding the seventh pin (70) along a predetermined guide path with respect to the frame (42).

2. An apparatus as in claim 1 wherein the guide means (76,78) includes a guide member (78) having a generally vertical guide path for the seventh pin (70), said member (78) being ridgidly attached to the frame (42).

3. An apparatus as in claim 1 wherein the guide means (76,80) includes a guide member (80) having a guide path for the seventh pin (70) that is inclined with respect to the vertical, said member (80) being rigidly attached to the frame (42).

4. An apparatus as in claim 1 wherein the guide means (76,82) includes a guide member (82) with a guide path for the seventh pin (70) that is mounted for motion relative to the frame (92) and means (84) mounted on the frame (42) for moving said guide path with respect to the frame (42).

5. An apparatus as in claim 1 wherein the guide means (76,86) includes a guide member (86) having a generally arcuate guide path for the seventh pin (70), said member (86) being mounted on the frame (42).

6. An apparatus as in claim 1 wherein the lower pair of links (68,69) includes an elongate control link (69) pinned to the link (60) in the medial pair of links (58,60) nearer the member (47), said control link (69) directly controls the motion of said link (60) nearer the member (47) and wherein the lower pair of links (68,69) also includes a drive link (68) pinned to the link (58) in the medial pair of links (58,60) nearer the frame (42) and wherein the apparatus includes means (73) for moving said links (68,69) with respect to the frame (42), said moving means (73) being mounted on the frame (42) and engaging the drive link (68).

7. An apparatus as in claim 1 wherein the seventh pin (10) includes a shaft (70) supporting a roller (76) that rides in a channel shaped guide member (78).

8. An apparatus for lifting a mast (47) on a fork lift truck (40), said truck (40) having a main frame (42), said main frame (42) having a forward end, comprising:

(a) a generally vertical mast (47) disposed adjacent the forward end of the main frame (42);

(b) a mounting tower (45) extending upwardly from the forward end of the main frame (42);

(c) a first pair of parallel arms (50,58) each having a rearward end and a forward end, said rearward ends of the first pair of arms (50,58) being pivotally connected to the mounting tower (45) at elevationally spaced apart locations thereon, said first pair of arms (50,58) extending from mounting tower in a longitudinal direction relative to said lift truck (40);

(d) a second pair of parallel arms (52,60) each having a rearward end and a forward end, said rearward ends of the second pair of arms being pivotally connected to the forward ends of a respective one of the first pair of arms (50,58) and the forward ends of the second pair of arms (52,60) being pivotally connected to the mast (47) at vertically spaced apart locations thereon, said second pair of arms (52,60) extending from said mast (47) in a longitudinal direction relative to said lift truck (40);

(e) a vertically extending link (66) having opposite ends and being pivotally connected at said opposite ends to the rearward ends of the second pair of arms (52,60);

(f) control linkage (68,69) having a drive link (68) and a control link (69), said drive link (68) being pivotally connected to one arm (58) of the first pair of arms (50,58), said control link (60) being pivotally connected to one arm (60) of the second pair of arms (52,60), and said drive link (68) and control link (69) being pivotally connected to each other;

(g) power means (73) for moving the mast (47) between a lowered position and a raised position, said power means (73) being connected to said drive link and said frame (42);

(h) a roller (76) rotatably connected to said control linkage; and a guide member (78) having a guide path disposed therein, said roller (76) being disposed in rolling engagement with said guide path and movable along said guide path in response to elevational movement of said lift mast, said guide member describing a path of elevational motion of said lift mast (47).

* * * * *